United States Patent [19]

Jewett, Sr.

[11] Patent Number: 4,597,226

[45] Date of Patent: Jul. 1, 1986

[54] APPARATUS FOR SHARPENING END MILLS

[76] Inventor: Bryce D. Jewett, Sr., 2901 Maury St., Richmond, Va. 23224

[21] Appl. No.: 691,212

[22] Filed: Jan. 14, 1985

Related U.S. Application Data

[63] Continuation-in-part of Ser. No. 519,811, Aug. 2, 1983, abandoned.

[51] Int. Cl.[4] ..... B24B 3/04

[52] U.S. Cl. ..... 51/92 ND; 51/225

[58] Field of Search ..... 51/92 R, 92 ND, 95, 51/219 R, 225, 288, 220

[56] References Cited

U.S. PATENT DOCUMENTS

| | | | |
|---|---|---|---|
| 2,420,170 | 5/1947 | Erikson | 51/92 R |
| 2,502,922 | 4/1950 | Bura | 51/220 X |
| 3,365,843 | 1/1968 | Robinson | 51/225 |
| 4,134,235 | 1/1979 | Maharidge | 51/225 X |

*Primary Examiner*—Harold D. Whitehead

*Attorney, Agent, or Firm*—Norman B. Rainer

[57] ABSTRACT

Apparatus for sharpening the face cutting edges of an end mill is comprised of a rotatable abrasive wheel and three platforms adapted to provide accurate positioning in a vertical and two lateral directions. The third platform, which is uppermost and tilted in the direction of the abrasive wheel, supports a rotatable turret having a chuck which holds the end mill. The apparatus permits stepwise contact of the land and chamfer zones of the trailing surface associated with each face cutting edge with the abrasive wheel rotating in a plane perpendicular to said trailing surface. The land and chamfer zones are caused to contact the abrasive wheel at two different sites in a lower quadrant of its circular periphery, thereby producing different inclinations of said zones. Because of the tilt of the third platform, both the land and chamfer zones have the same dish angle of between about 0° and 3°.

5 Claims, 7 Drawing Figures

APPARATUS FOR SHARPENING END MILLS

RELATED APPLICATIONS

This is a continuation-in-part application based upon application Ser. No. 519,811, filed 08/02/83 and now abandoned.

BACKGROUND OF THE INVENTION

This invention relates to the sharpening of rotary metal-cutting tools known as end mills, and more particularly concerns apparatus for sharpening the face cutting edges of end mills to produce critically defined primary and secondary clearance angles and dish angle.

Milling tools are extensively used for the machining of metal structures to desired shapes. The milling tool, generally fabricated of special alloy steel having a very high hardness, is an integral monolithic structure comprised of a spindle or shaft portion and a cutting head portion disposed at an extremity of said shaft portion and coaxial therewith. The cutting head is comprised of a core which is substantially a continuation of the shaft, and a number of flutes upraised from the core, the outermost extremities of said flutes having elongated cutting edges in parallel juxtaposition symmetrically disposed about the tool axis. The cutting edges of the flutes, generally referred to as the side or axial cutting edges are disposed in a circular cylindrical locus about the tool axis, said edges being either straight and parallel to the axis, or helically disposed to the axis. The diameter of the cylindrical perimeter of the cutting head will generally range from about 0.125" to 4.0".

The cutting head terminates at the end of the milling tool substantially in a plane perpendicular to the axis, said plane being generally referred to as the cutting face and provided with cutting edges substantially radially oriented with respect to the axis. Each face cutting edge is associated with a side cutting edge in a manner such that the extremities of said edges meet at sites defining a circle centered on the axis and perpendicular thereto, said circle lying in a plane which may be considered the effective plane of the cutting face.

When the end mill is rotated about its axis and forcibly applied against a workpiece, the face cutting edges will cut metal from a surface of the workpiece in planes parallel to the cutting face. The side cutting edges of the end mill permit cutting of metal in directions transverse to the rotational axis. By such mode of function, the milling tool is capable of operating in three dimensions upon the workpiece.

The face cutting edges are straight edges which are angled with respect to the plane of the cutting face such that the innermost extremity of the edge is displaced from said plane in the direction of the spindle. The angle between the face cutting edge and the plane of the cutting face is generally referred to as the base cutting edge angle or "dish" angle and usually has a value between 0° and 3°.

Each face cutting edge is comprised of a leading surface and a trailing surface. The leading surface is disposed in a plane which is parallel to the tool axis in the case of straight flutes, and angled to the axis in the case of helical flutes. The trailing surface forms an angle of between 4° and 12° with respect to the plane or conical surface containing all the face cutting edges, said angle generally being referred to as the primary clearance angle and being approximately the same as the angle between the trailing surface and plane of the cutting face. The trailing surface is generally provided with a chamfer in a zone spaced away from the cutting edge. The purpose of the chamfer is to facilitate removal of metal chips and thereby reduce wear of the tool. The zone of the trailing surface between the cutting edge and the beginning of the chamfer is referred to as the land. The angle between the chamfer and the plane of the cutting face is generally 10° greater than the primary clearance angle, and this is generally referred to as the secondary clearance angle.

After prolonged use, the cutting edges of the end mill must be sharpened. The sharpening technique requires high precision in order to maintain the proper critical dimensional characteristics of the cutting edges. Sharpening is generally accomplished by contacting the trailing surfaces of the cutting edges with a rapidly rotating abrasive wheel comprised of a composition containing alundum, carborundum, diamond or other materials having a hardness above 9.0 on the original Mohs Hardness Scale. In order to secure accurate and uniform cutting edge angles, special holding and guiding equipment is required to precisely present the cutting edges to the abrasive wheel. Such equipment heretofore available for the precision sharpening of milling tools has required time-consuming manipulations, repeated adjustments and re-mountings of the milling tool to secure the sought cutting edge angles and to compensate for factors such as the diameter and configuration of the cutting head.

For example, in U.S. Pat. No. 4,134,235 to Maharidge, repeated tilting adjustments must be made in the apparatus that holds the milling tool in order to secure the appropriate dish angle on each edge. Such repeated manipulations of the sharpening apparatus not only prolong the time needed for the sharpening operation, but increase the risk of operator errors.

It is accordingly an object of the present invention to provide apparatus for the precision rapid sharpening of the face cutting edges of an end mill.

It is another object of the present invention to provide apparatus as in the foregoing objective which grinds the trailing surfaces of said edges to establish proper primary and secondary clearance angles.

It is a further object of the invention to provide apparatus of the aforesaid nature which additionally establishes a proper base cutting edge angle or dish angle of said cutting edges.

It is still another object of the present invention to provide apparatus of the aforesaid nature which, with a single mounting of a milling tool, will accomplish the aforesaid objectives.

These objects and other objects and advantages of the invention will be apparent from the following description.

SUMMARY OF THE INVENTION

The apparatus of the present invention is preferably disposed in a manner to maintain the mounted end mill in a substantially vertical position, and accordingly such embodiment will be described although other embodiments of apparatus which hold the end mill in other orientations are within the purview of this invention.

The apparatus comprises:

(a) a vertical stand, (b) a rotatable abrasive wheel mounted to said stand adjacent an upper extremity thereof and having a circular diameter preferably between 3 and 10 inches, (c) a first platform which engages a lower portion of said stand in a manner to be positionable thereupon at precisely determined elevations, (d) a second platform mounted atop said first platform in a manner to be movable in a first lateral direction of displacement to and from said stand, and associated means to limit the extent of displacement in said first lateral direction, (e) a third platform mounted atop said second platform in a manner to be movable in a second lateral direction of displacement perpendicularly disposed to said first lateral direction of displacement, and means associated with said third platform for limiting the extent of movement in said second lateral direction, (f) the manner of mounting of said third platform to said second platform being such as to present a tilted effect wherein the extremity of said third platform closest said stand is at a lower elevation than its diametrically opposed extremity, (g) a circular turret rotatably positioned atop said third platform, the base of said turret having a scale of angular markings and provided with means for locking the position of the turret at a desired marking, (h) holding means such as a chuck or collet centered in said turret and adapted to hold an end mill in a manner such that, in the course of movement of the end mill in said first lateral direction of displacement toward the abrasive wheel, the face cutting edge of the end mill will contact the circular periphery of said abrasive wheel in a manner such that said circular periphery is substantially perpendicularly disposed to said cutting edge, and the linear extension of the axis of said end mill passes close to the rotational axis of said abrasive wheel, and (i) alignment means associated with said turret to orient face cutting edges to markings on the base of said turret.

The manner of utilizing the apparatus comprises:

(a) mounting an end mill in the aforesaid apparatus having the capability of moving the end mill in the following modes: (1) rotation about its axis, (2) displacement in the direction of its axis, and (3) lateral displacement in first and second directions 90° apart, (b) the axis of said mounted end mill being held at a fixed angle of about 87°–90° with respect to said first direction of lateral displacement, and 90° with respect to said second direction of lateral displacement, (c) positioning said mounted end mill so that a face cutting edge to be sharpened is aligned with said first lateral direction of displacement, (d) moving said end mill in said first lateral direction of displacement toward said abrasive wheel rapidly rotating in a plane perpendicular to said first lateral direction of displacement and parallel to said second lateral direction of displacement, (e) causing a first site of the periphery of said abrasive wheel to uniformly contact successive portions of the trailing surface of said cutting edge between the outer perimeter of the end mill and the axis thereof, thereby causing said cutting edge to have a concavely shaped land, a primary clearance angle of 4° to 12° and a base cutting edge angle between 0° and 3°, said first site of the periphery of said abrasive wheel being selected such that a linear extension of the end mill axis passes close to the center of said abrasive wheel, (f) removing the mounted end mill from contact with the abrasive wheel, and axially rotating the still-mounted end mill to the other face cutting edges, and repeating step e, (g) moving the mounted end mill in said second direction of lateral displacement, (h) moving the mounted end mill in said first direction of lateral displacement, and into contact with a second site of the periphery of said abrasive wheel, said second site being located such that a linear extension of the end mill axis is further in the second site than the first site from the center of the abrasive wheel, (i) causing said abrasive wheel to uniformly contact successive portions of the trailing surface of said cutting edge between the outer perimeter of the end mill and the axis thereof to form a concavely contoured chamfer having a secondary clearance angle of about 14°–22°, and (j) removing the mounted end mill from contact with the abrasive wheel, rotating it, and repeating step i with the other face cutting edges.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
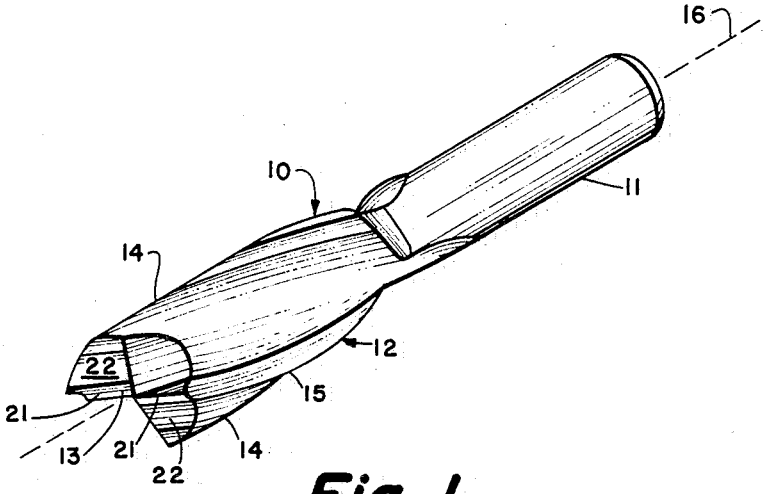
FIG. 1 is a perspective view of an end mill that may be sharpened by the apparatus of the present invention.
Figure 2:
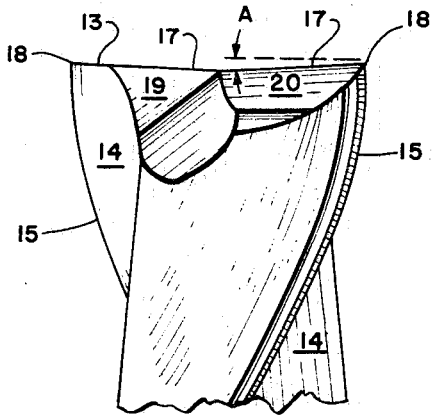
FIG. 2 is an enlarged fragmentary side view of the end mill of FIG. 1.
Figure 3:
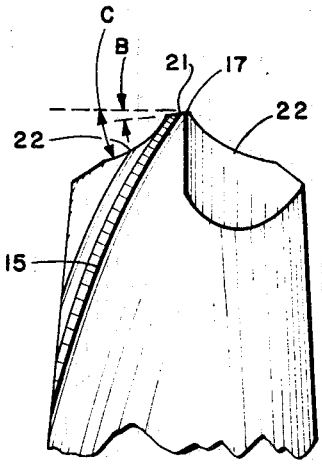
FIG. 3 is a fragmentary side view of the end mill rotated 90° from the view of FIG. 2.

Referring to FIGS. 1–3, an end mill tool 10 of monolithic construction is shown comprised of a shaft portion 11 and a cutting head portion 12 disposed at one extremity of said shaft portion and coaxial therewith. The cutting head is comprised of two helical flutes 14 having elongated side cutting edges 15 in parallel juxtaposition symmetrically disposed about the tool's rotational axis 16. The side cutting edges 15 are located in a circular cylindrical array or locus about said axis, and the cutting head may accordingly be said to be of the cylindrical type. In other embodiments of cutting heads which may be sharpened by the method and apparatus of this invention, greater numbers of flutes may be present. Also, the flutes and their cutting edges may be straight and parallel to axis 16. The diameter of the cutting head may be considered to be the diameter of the circular cylindrical array of the side cutting edges.

The terminal extremity 13 of the cutting head distal from shaft portion 11 is referred to as the cutting face, and is disposed in a plane substantially perpendicular to axis 16. Cutting face 13 is comprised of two face cutting edges 17, each being straight and angled downwardly in going from the outer perimeter of the cutting head to axis 16. Said angle, shown as Angle A in FIG. 2, and generally referred to as the base cutting edge angle, usually has a value between about 0° and 3°. Angle A may be further defined as the angle formed within a plane containing axis 16, between face cutting edge 17 and a face plane perpendicular to axis 16 and containing the outer extremities 18 of both face cutting edges. It is to be noted that said outer extremities 18 meet the extremities of side cutting edges 15 in the usual configuration of cutting edges in an end mill.

Each face cutting edge 17 is defined as the apex between a leading surface 19 and a trailing surface 20. Adjacent each face cutting edge on the trailing surface is a zone 21 generally referred to as a land. Further removed from the cutting edge, and contiguous to the land on the trailing surface is a zone 22 generally referred to as a chamfer. It should be noted that both the land and the chamfer are concave in the manner of cylindric surfaces whose axes parallel the length of the cutting edge. This is a characteristic feature of end mills sharpened by the method of the present invention. The angle between land 21 and the above-defined face plane, and designated angle B in FIG. 3, is generally referred to as the primary clearance angle, and usually has a magnitude of 4° to 12°. The angle between the face plane and chamfer 22, and designated angle C in FIG. 3, is generally referred to as the secondary clearance angle, and usually has a magnitude of 10° greater than the primary clearance angle.

Figure 4:
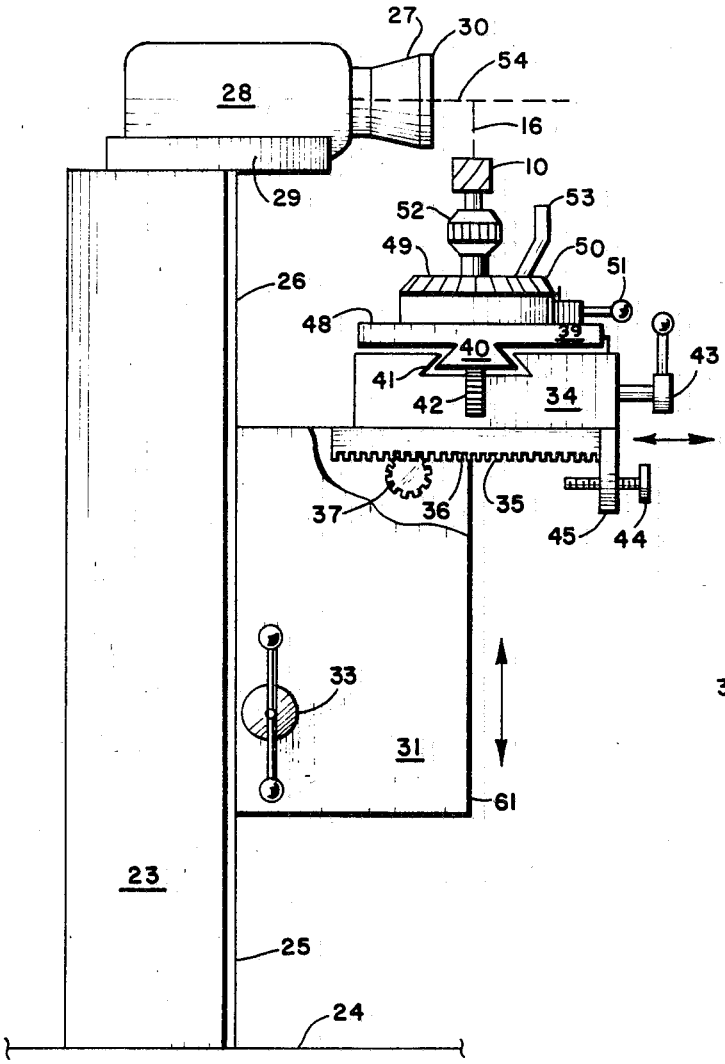
FIG. 4 is a side view of the apparatus of the present invention, with portions cut away to reveal interior detail.
Figure 5:
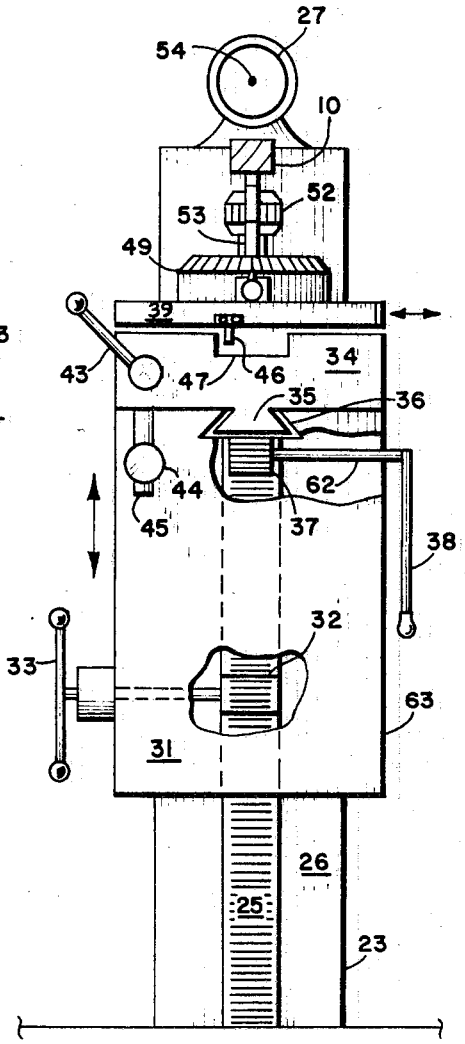
FIG. 5 is a front view of the apparatus of FIG. 4, with portions cut away to reveal interior detail.
Figure 6:
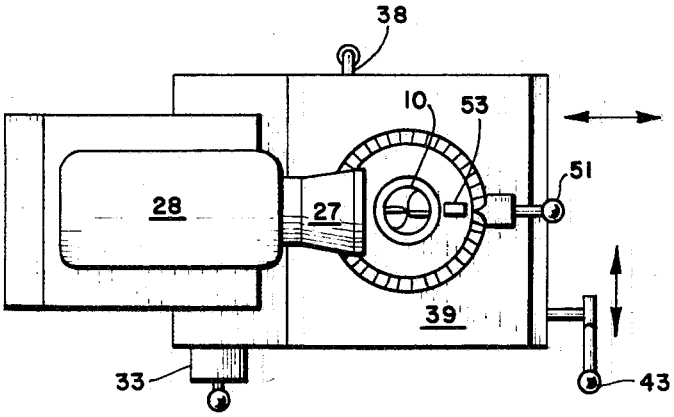
FIG. 6 is a top view of the apparatus of FIG. 4.

The apparatus of the present invention shown in FIGS. 4–6 is comprised of a standard 23 adapted for secure emplacement upon a floor 24, and provided with a straight toothed rail 25 of trapezoidal cross section mounted upon front surface 26. An electric motor 28, which drives abrasive wheel 27, is attached by bracket 29 to the upper extremity of standard 23 in a manner such that the forward extremity 30 of wheel 27 protrudes in front of front surface 26.

A first platform 31 engages standard 23 by means of a recessed track, not shown, which slideably engages toothed rail 25. Gear wheel 32, controlled by micrometer handwheel 33, engages the teeth of rail 25, causing said first platform to be vertically positionable upon said standard. Adjustable abutment means, not shown, may optionally be attached to said standard to limit the upward extent of travel of said first platform. Other equivalent means may be utilized to cause controlled movement of said first platform upon said standard.

A second platform 34 engages the upper extremity of said first platform by toothed rail 35 which engages track 36 recessed into said first platform. Gear wheel 37 is attached to the extremity of extension rod 62 journaled to sidewall 63 of said first platform and affixed to lever 38. Gear wheel 37 engages the teeth of rail 35, causing said second platform to be movable in a first lateral mode to and from said standard. An abutment bolt 44 threadably engages tab 45 pendant from said second platform and coacts with front surface 61 of said first platform to limit the extent of motion of said second platform toward said standard.

A third platform 39 engages the upper extremity of said second platform by toothed rail 40 which engages track 41 recessed into the upper surface of said second platform. Gear wheel 42, controlled by lever 43 positioned in the second platform, engages the teeth of rail 40, causing said third platform to be movable in a second lateral mode which is perpendicular to the direction of movement of the first lateral mode. Tab 46, pendant from the third platform, fits into recess 47 in the upper surface of the second platform, thereby providing two limits of said second lateral motion.

The upper surface 48 of the third platform is downwardly sloped toward the standard. The angle of the slope with respect to a horizontal plane is essentially equal to the aforementioned Angle A.

A circular turret 49 is rotatably mounted atop the third platform. A scale of angular markings 50 is provided about the base of the turret. A detent locking means 51 is provided to lock the position of the turret in any desired angular position. In some embodiments, the base of the turret may be toothed, and the locking means may be a spring-biased pin adapted to engage said toothed base.

Holding means in the form of chuck 52 is centrally mounted atop said turret, and adapted to hold an end mill 10 in a manner such that its cutting face 13 is at substantially the same elevation as the bottom of abrasive wheel 27, and the axis 16 of the end mill almost intersects the rotational axis 54 of the abrasive wheel.

A flat elongated alignment guide 53 extends upwardly from turret 49, the purpose of said guide being to facilitate positioning of the end mill in the chuck in a manner such that the face cutting edges are aligned with appropriate angular markings on the base of the turret and also aligned with said first lateral direction of displacement.

In the sharpening method of this invention, a suitable end mill is placed in the chuck. A straight edge is utilized to cause a face cutting edge to be coplanar with the flat surface of alignment guide 53, and the chuck is then tightened. Suitable adjustments are made in the apparatus to secure the sought sharpening characteristics. By virtue of the slope of upper surface 48 of the third platform, the axis of the end mill is displaced from vertical by an amount equal to angle A, thereby securing the proper dish angle regardless of its relative position within the chuck.

Figure 7:
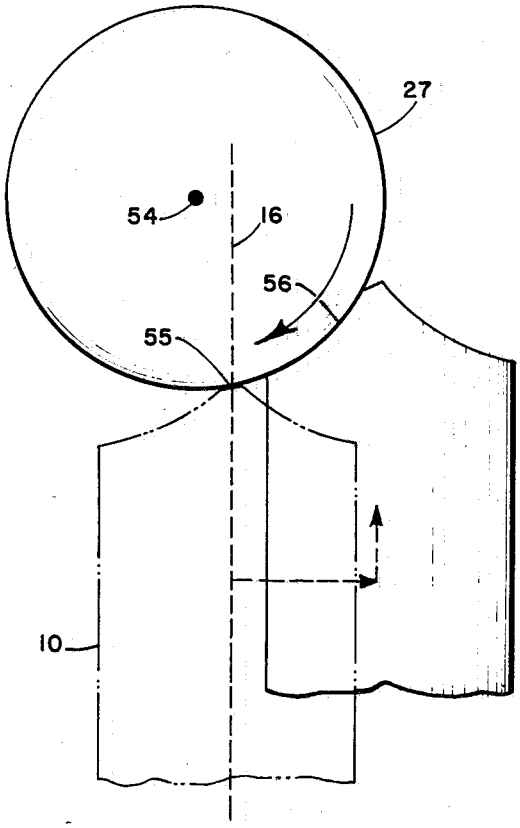
FIG. 7 is a schematic view illustrating steps in the sharpening method.

The second platform is then caused to move in the direction of the rotating abrasive wheel. The land of the cutting edge is thereby caused to contact the abrasive wheel at a lowermost first site 55, shown in FIG. 7. The land is advanced only as far as the end mill center axis into sharpening contact with the abrasive wheel, and the end mill is then withdrawn and axially rotated to the next adjacent face cutting edge, whereupon the land sharpening operation is repeated. When all the lands have been resurfaced, the third platform is shifted in said second lateral displacement mode, and the apparatus is elevated by handwheel 33 of said first platform. Such repositioning of the end mill is illustrated in FIG. 7.

The end mill is again advanced toward the abrasive wheel in the first lateral displacement mode. Now, however, the end mill contacts the abrasive wheel at a second site 56 which is higher than said first site. Also, contact is now made with the chamfer surface. In the same manner as in the case of the resurfacing of the lands, the resurfacing of the chamfer surfaces is conducted. It is to be noted that both first and second sites of sharpening contact are located within the same lower quadrant of the periphery of said wheel. The mid-points of the arc-shaped sites are spaced apart by between about 10° and 40° of angular separation about the rotational axis of said wheel.

By virtue of the aforesaid procedure, a concave configuration is imparted to both the land and the chamfer surfaces associated with each face cutting edge of the end mill, and all surfaces and edges are caused to have their appropriate angular characteristics. The contours of the concave surfaces are essentially arcs of circles having the radius of the abrasive wheel, namely about 1.5 to 5 inches. The concave surface is in fact a portion of a circular cylindric surface because its curvature is uniform throughout its length. In comparison with end mills of the prior art wherein the land and chamfer surfaces are flat, the end mills of this invention require less torque for operation, generate less heat, and incur less wear. It is felt that said advantages may in part be explainable on the basis that metal cuttings removed from a surface are curved in the direction of the trailing surface. The concave configurations of the land and chamfer thereby minimize frictional contact between the end mill and the cuttings.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. Apparatus for sharpening the face cutting edges of an end mill comprising:

(a) a vertical stand, (b) a rotatable abrasive wheel mounted to said stand and having a circular periphery, (c) a first platform which engages a lower portion of said stand in a manner to be positionable thereupon at precisely determined elevations, (d) a second platform mounted atop said first platform in a manner to be movable in a first lateral direction of displacement to and from said stand, and associated means to limit the extent of displacement in said first lateral direction, (e) a third platform mounted atop said second platform in a manner to be movable in a second lateral direction of displacement perpendicularly disposed to said first lateral direction of displacement, and means associated with said third platform for limiting the extent of movement in said second lateral direction, (f) said third platform having an upper surface which is downwardly sloped toward said vertical stand, thereby presenting a tilted effect wherein the extremity of said third platform closest said stand is at a lower elevation than its diametrically opposed extremity, (g) a turret rotatably positioned atop said third platform, said turret having a scale of angular markings and provided with means for locking the position of the turret at a desired marking, (h) holding means centered in said turret and adapted to hold an end mill in a manner such that, in the course of movement of the end mill in said first lateral direction of displacement toward the abrasive wheel, the face cutting edge of the end mill will contact the circular periphery of said abrasive wheel in a manner such that said circular periphery is substantially perpendicularly disposed to said cutting edge, and (i) elongated alignment means extending upwardly from said turret to orient face cutting edges to markings on said turret.

2. The apparatus of claim 1 wherein the periphery of said wheel has a diameter in the range of 3 to 10 inches.

3. The apparatus of claim 1 wherein said turret has a circular base, and said angular markings are associated with said circular base.

4. The apparatus of claim 1 wherein the linear extension of the axis of an end mill held by said holding means passes close to the rotational axis of said abrasive wheel.

5. The apparatus of claim 4 wherein the extent of movement in said second lateral direction is such as to enable the end mill to contact said abrasive wheel at two sites located within a lower quadrant of said wheel.

* * * * *